US007716893B1

(12) United States Patent
King

(10) Patent No.: US 7,716,893 B1
(45) Date of Patent: May 18, 2010

(54) WALL RESURFACING KIT AND ASSOCIATED METHOD

(76) Inventor: Harry King, 12 BeeHive Pl., Apt F, Cockeysville, MD (US) 21030

( * ) Notice: Subject to any disclaimer, the term of this patent is extended or adjusted under 35 U.S.C. 154(b) by 0 days.

(21) Appl. No.: 12/151,971

(22) Filed: May 9, 2008

Related U.S. Application Data

(60) Provisional application No. 60/928,444, filed on May 10, 2007.

(51) Int. Cl.
*E02D 37/00* (2006.01)

(52) U.S. Cl. ..... 52/514.5; 52/514; 52/742.16; 52/742.1; 156/94; 156/290; 428/77; 428/57

(58) Field of Classification Search ..... 52/514, 52/514.5, 742.16, 742.14, 741.4, 742.1; 156/94, 290, 292; 159/94; 428/77, 194, 428/193, 57, 157, 58, 904.4
See application file for complete search history.

(56) References Cited

U.S. PATENT DOCUMENTS 2,116,008 A * 5/1938 Block ..... 428/163
2,128,480 A * 8/1938 Wertz ..... 52/514
2,162,658 A * 6/1939 Wieslander ..... 52/741.41
2,487,830 A * 11/1949 Robbins ..... 442/2
2,598,194 A * 5/1952 Shippey ..... 52/514
3,311,696 A * 3/1967 Melnick ..... 174/18
4,100,712 A * 7/1978 Hyman ..... 52/514
4,135,017 A * 1/1979 Hoffmann, Sr. ..... 428/78
4,620,407 A * 11/1986 Schmid ..... 52/745.09
4,668,547 A * 5/1987 Brouessard ..... 428/41.7
4,707,391 A * 11/1987 Hoffmann, Sr. ..... 428/63
4,732,633 A * 3/1988 Pokorny ..... 156/94
5,064,713 A 11/1991 DuLaney
5,075,149 A * 12/1991 Owens et al. ..... 428/138
5,204,148 A * 4/1993 Alexander et al. ..... 428/41.8
5,269,861 A * 12/1993 Gilbreath ..... 156/98
5,298,099 A * 3/1994 Hoffmann, Sr. ..... 156/94
5,452,558 A * 9/1995 Eastin ..... 52/741.4
5,501,894 A * 3/1996 Lagemann et al. ..... 428/57
5,620,768 A * 4/1997 Hoffmann, Sr. ..... 428/77
5,654,063 A * 8/1997 Kirk et al. ..... 428/77
5,676,999 A * 10/1997 Silva ..... 427/140
5,705,006 A * 1/1998 Roudebush et al. ..... 156/98
5,839,241 A * 11/1998 Cacossa et al. ..... 52/255
5,960,603 A * 10/1999 Redden et al. ..... 52/514
6,149,749 A * 11/2000 McBroom ..... 156/94
6,162,525 A * 12/2000 Amy ..... 428/119
6,231,949 B1 * 5/2001 Hoffmann, Sr. ..... 428/139
6,450,729 B1 * 9/2002 Clapp ..... 404/75
6,490,828 B1 12/2002 Fuller
6,619,360 B1 * 9/2003 Roesler et al. ..... 156/494
6,627,292 B1 * 9/2003 Hoffmann, Sr. ..... 428/139

(Continued)

*Primary Examiner*—Robert J Canfield
*Assistant Examiner*—Matthew Gitlin

(57) ABSTRACT

A wall resurfacing kit for allowing users to quickly and easily resurface a damaged wallpapered surface includes a plurality of rectangular mesh screen sheets. The plurality of mesh screen sheets are made of fiberglass and are directly attachable to the wallpapered surface. The wall resurfacing kit further includes a reinforcing member. The reinforcing member is applied directly onto the mesh screen sheets such that the reinforcing member penetrates through the mesh screen sheets. The reinforcing member directly couples the plurality of mesh screen sheets to the wallpapered surface. The wall resurfacing kit further includes a set of instructions indicating a decoration mode. The decoration mode is used to decorate the wallpapered surface.

17 Claims, 6 Drawing Sheets

U.S. PATENT DOCUMENTS 6,775,953 B2 8/2004 Burken
6,952,904 B2 * 10/2005 Nickel ..... 52/698
6,984,283 B1 * 1/2006 Noriega ..... 156/256
7,107,924 B2 * 9/2006 Schroeder ..... 114/229
2005/0124239 A1 * 6/2005 Griner, Jr. ..... 442/24
2006/0096220 A1 * 5/2006 Greer et al. ..... 52/514
2007/0087151 A1 * 4/2007 Hoffmann et al. ..... 428/40.1
2008/0148669 A1 * 6/2008 Ehrman et al. ..... 52/514

* cited by examiner

WALL RESURFACING KIT AND ASSOCIATED METHOD

CROSS REFERENCE TO RELATED APPLICATIONS

This application claims the benefit of U.S. Provisional Application No. 60/928,444, filed May 10, 2007, the entire disclosures of which are incorporated herein by reference:

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to wall resurfacing kits and, more particularly, to a wall resurfacing kit for allowing users to quickly and easily resurface wallpapered walls.

2. Prior Art

Wallpaper is a well known covering that can selectively be applied to entire wall surfaces or to only select portions thereof. Sometimes, however, a person may no longer like the color or pattern displayed on the wall paper and may wish to change it. Also, in the even that a home is sold the new owners may not have the same affinity for the current wallpaper as the previous residents did. The conventional method of removing wall paper is rather time consuming, requiring a lot of patience and effort. At times the wallpaper can not be completely removed in certain areas, thus complicating the application of new wallpaper, or painting over the desired surface.

Accordingly, a need remains for a wall resurfacing kit in order to overcome the above-noted shortcomings.

BRIEF SUMMARY OF THE INVENTION

In view of the foregoing background, it is therefore an object of the present invention to provide an apparatus for allowing users to quickly and easily resurface wallpapered walls. These and other objects, features, and advantages of the invention are provided by a wall resurfacing kit.

A wall resurfacing kit for allowing users to quickly and easily resurface a damaged wallpapered surface includes a plurality of rectangular mesh screen sheets. The plurality of mesh screen sheets are made of fiberglass and are directly attachable to the wallpapered surface.

The wall resurfacing kit further includes a reinforcing member. The reinforcing member is applied directly onto the mesh screen sheets such that the reinforcing member penetrates through the mesh screen sheets. The reinforcing member directly couples the plurality of mesh screen sheets to the wallpapered surface. The wall resurfacing kit further includes a set of instructions indicating a decoration mode. The decoration mode is used to decorate the wallpapered surface.

The plurality of mesh screen sheets overlap each other and each mesh screen sheet of the plurality of mesh screen sheets measures approximately eight feet to twelve feet in length, approximately four feet in width and approximately less than one sixteenths of an inch in thickness.

The reinforcing member directly couples the plurality of mesh screen sheets to the wallpapered surface in such a manner that the plurality of mesh screen sheets are intercalated between the reinforcing member and the wallpapered surface.

In one embodiment, the reinforcing member is a spackling mixture selected from a group of materials including an element a compound, a powder and any combination thereof. The spackling mixture is applied in one form selected from a group comprising a solid, a liquid and a paste. The reinforcing member is applied over the plurality of mesh screen sheets.

The decoration mode of the set of instructions includes a wallpaper design, a paint color and a paint applicator.

In use, a method for using a wall resurfacing kit to quickly and easily resurface a damaged wallpapered surface without having to remove damaged wallpaper from the wallpapered surface includes identifying the damaged wallpapered surface; providing a plurality of fiberglass and rectangular shaped mesh screen sheets over the damaged wallpapered surface; providing a reinforcing member; coupling the plurality of mesh screen sheets directly to the damaged wallpapered surface by directly applying the reinforcing member to the mesh screen sheets such that the reinforcing member penetrates through the mesh screen sheets; providing a set of instructions indicating a decoration mode for decorating the wallpapered surface; and decorating the wallpapered surface based upon a selected one of the decoration mode.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTIVE KEY

Figure 1:
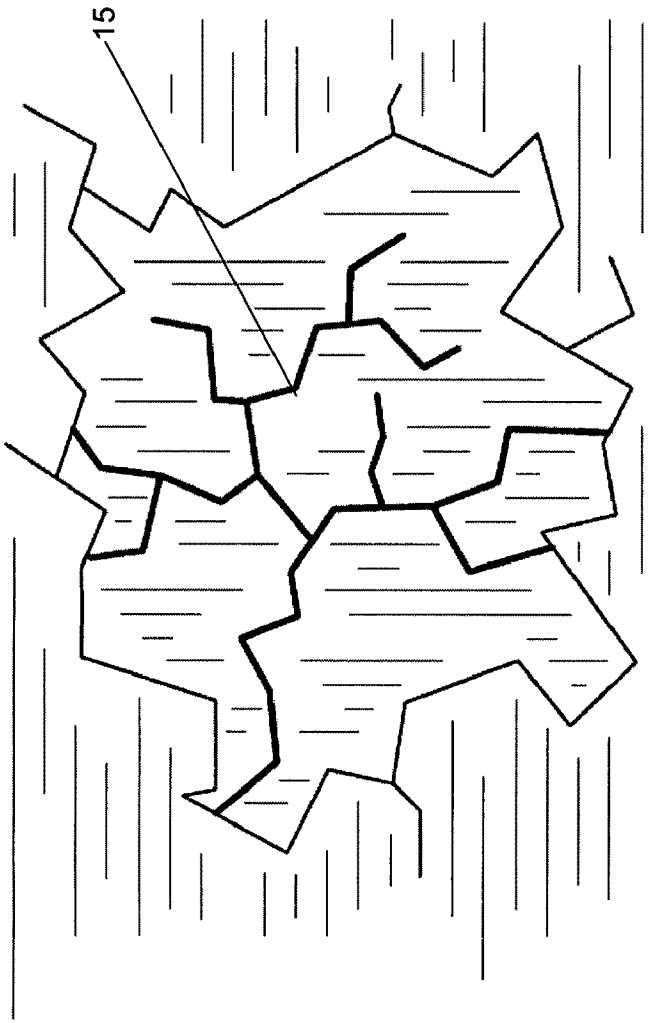
FIG. 1 is a front view showing a damaged wallpaper surface, in accordance with an aspect of the present invention.
Figure 2:
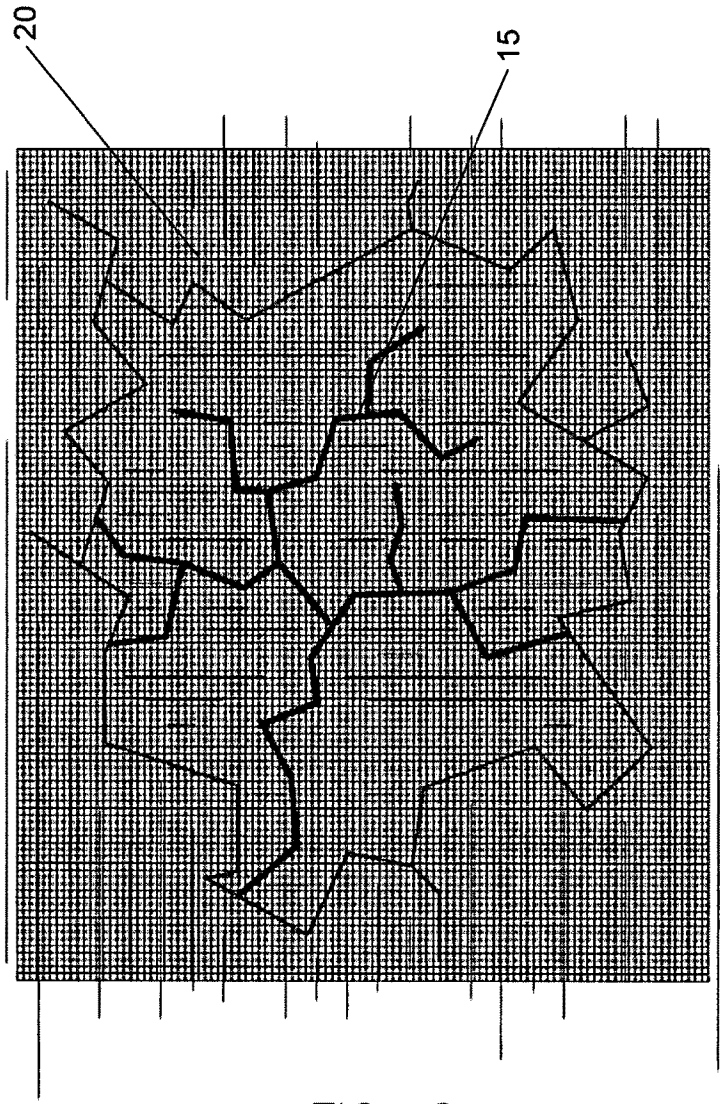
FIG. 2 is a front view showing an application of a mesh screen sheet to the damaged wallpaper surface, in accordance with an aspect of the present invention.
Figure 3:
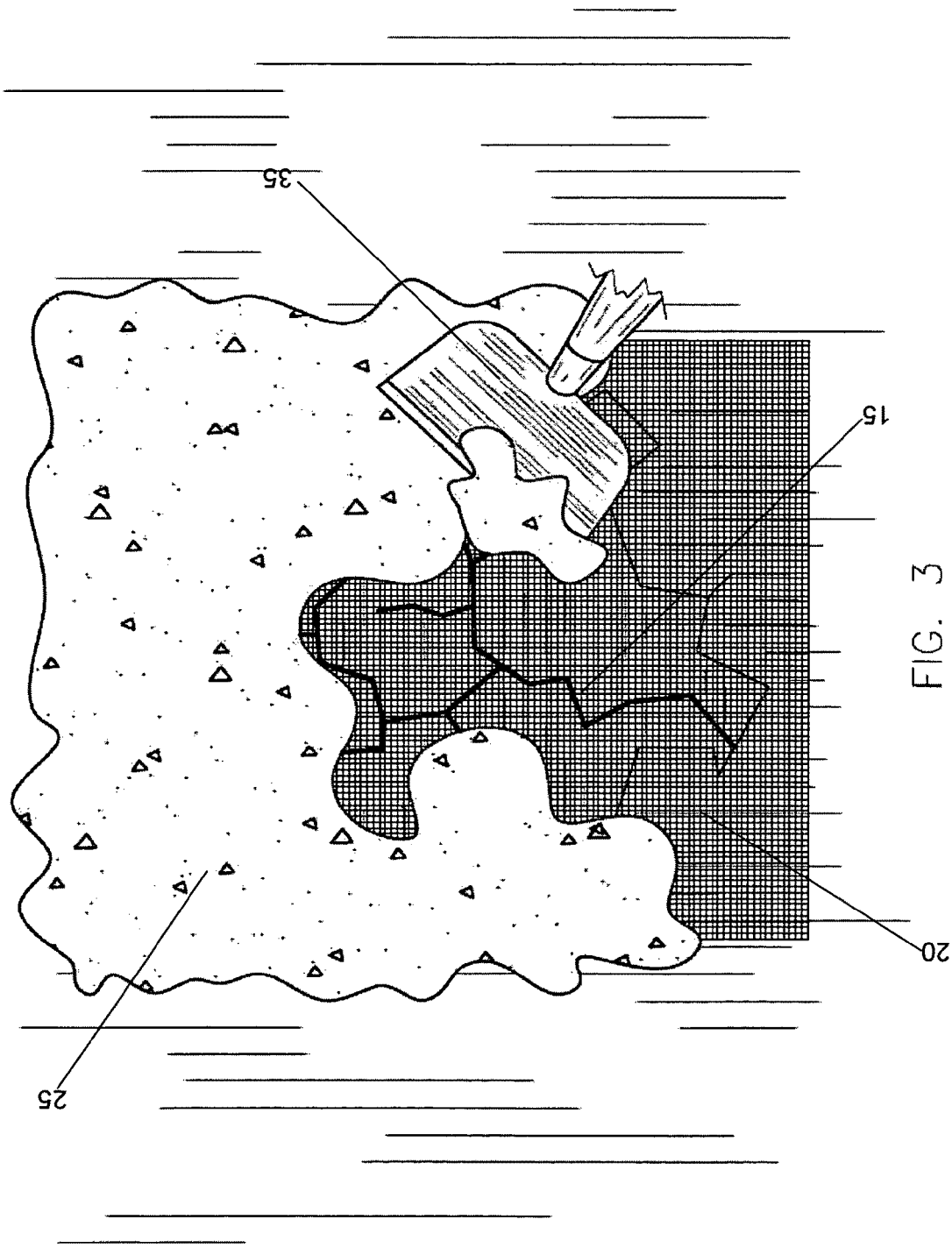
FIG. 3 is a front view showing an application of a reinforcing member, in accordance with an aspect of the present invention.
Figure 4:
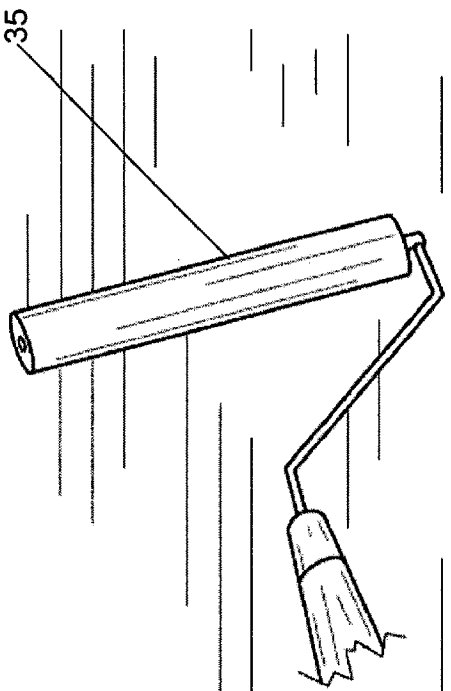
FIG. 4 is a front view showing a resurfaced wallpaper surface, in accordance with an aspect of the present invention.
Figure 4:
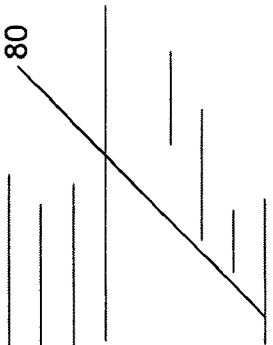
Figure 5:
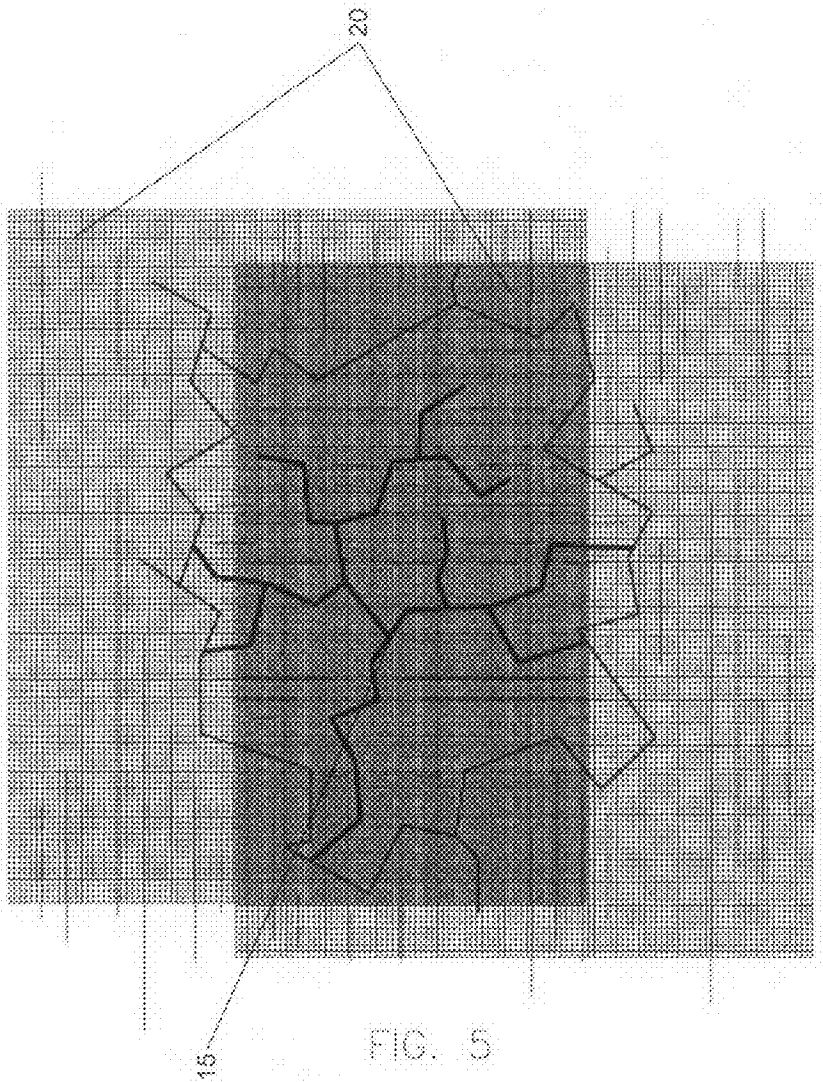
FIG. 5 is a front view showing an application of a plurality of mesh screen sheets to the damaged wallpaper surface, in accordance with an aspect of the present invention.

10 Wall resurfacing kit
15 damaged wallpaper surface 35 decoration mode
20 mesh screen sheets 40-70 instructions
25 reinforcing member 80 resurfaced wall
30 set of instructions

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a wall resurfacing kit 10. It should be understood that the wall resurfacing kit 10 may be used to cover many different types of wall finishes and should not be limited in use to only covering wallpaper covered walls.

Referring now to FIGS. 1, 2, 3, 4 and 5, a wall resurfacing kit 10 for allowing users to quickly and easily resurface a damaged wallpapered surface 15 includes a plurality of rectangular mesh screen sheets 20. The plurality of mesh screen sheets 20 are made of fiberglass and are directly attachable to the wallpapered surface 15.

The wall resurfacing kit 10 further includes a reinforcing member 25. The reinforcing member 25 is applied directly onto the mesh screen sheets 20 such that the reinforcing member 25 penetrates through the mesh screen sheets 20. The reinforcing member 25 directly couples the plurality of mesh screen sheets 20 to the wallpapered surface 15. The wall resurfacing kit 10 further includes a set of instructions 30 indicating a decoration mode 35. The decoration mode 35 is used to decorate the wallpapered surface 15.

The plurality of mesh screen sheets 20 overlap each other and each mesh screen sheet 20 of the plurality of mesh screen sheets 20 measures approximately eight feet to twelve feet in length, approximately four feet in width and approximately less than one sixteenths of an inch in thickness.

The reinforcing member 25 directly couples the plurality of mesh screen sheets 20 to the wallpapered surface 15 in such a manner that the plurality of mesh screen sheets 20 are intercalated between the reinforcing member 25 and the wallpapered surface 15.

In one embodiment, the reinforcing member 25 is a spackling mixture selected from a group of materials including an element a compound, a powder and any combination thereof. The spackling mixture is applied in one form selected from a group comprising a solid, a liquid and a paste. The reinforcing member 25 is applied over the plurality of mesh screen sheets 20.

The decoration mode 35 of the set of instructions 30 includes a wallpaper design, a paint color and a paint applicator.

Figure 6:
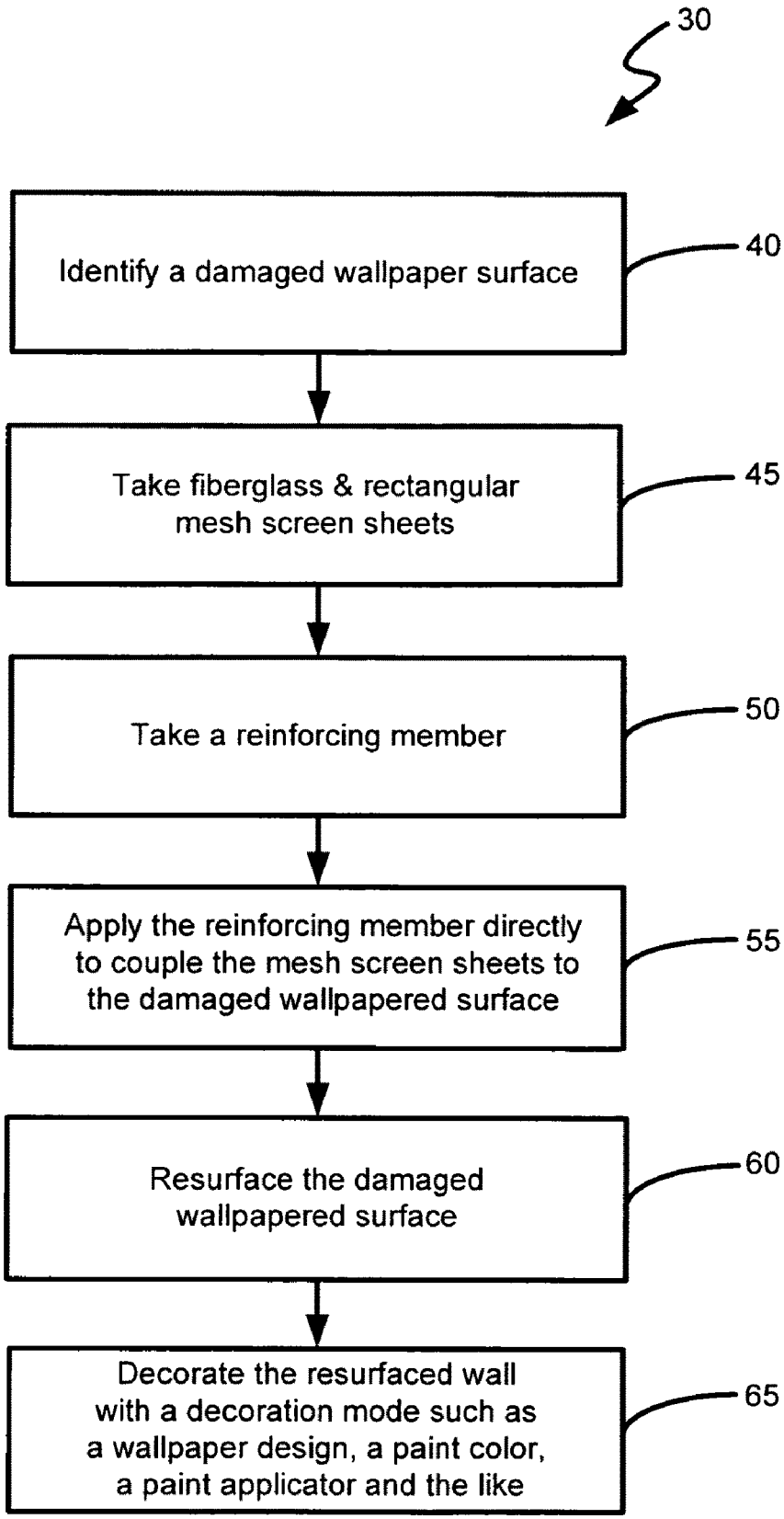
FIG. 6 is a flow diagram illustrating a set of instructions to resurface a damaged wallpaper surface, in accordance with an aspect of the present invention.

Referring now to FIG. 6, the set of instructions 30 include a plurality of steps. At step 40, the damaged wallpaper surface 15 is identified. At step 45, the plurality of fiberglass and rectangular shaped mesh screen sheets 20 are taken. At step 50, the reinforcing member 25 is taken. At step 55, the reinforcing member 50 is directly applied to couple the plurality of mesh screen sheets 20 to the damaged wallpaper surface 15. At step 60, the damaged wallpaper surface 15 is resurfaced using the wall resurfacing kit 10. At step 65, a resurfaced wall 80 is decorated with the decoration mode 35. In one embodiment, the decoration mode 35 is a wallpaper, a paint, a paint applicator and the like.

The present invention, as claimed, provides the unexpected and unpredictable benefits by providing a wall resurfacing kit that is convenient and easy to use, is versatile in its applications, and eliminates the need to spend hours peeling away old wallpaper, allowing users to simply cover it up in a neat and easy way. Since it is extremely easy to use, the present invention can be used by decorators of any skill level. While this wall resurfacing kit is conceived with do-it-yourselfers in mind, professional interior decorators as well as contractors certainly find the present invention to be a valuable tool for assisting them in serving their clients. The wall resurfacing kit allows users to easily and creatively add style and charm to any room, without the hassles commonly associated with the wallpaper removal.

In use, a method for using a wall resurfacing kit 10 to quickly and easily resurface a damaged wallpapered surface 15 without having to remove damaged wallpaper from the wallpapered surface 15 includes identifying the damaged wallpapered surface 15; providing a plurality of fiberglass and rectangular shaped mesh screen sheets 20 over the damaged wallpapered surface 15; providing a reinforcing member 25; coupling the plurality of mesh screen sheets 20 directly to the damaged wallpapered surface 15 by directly applying the reinforcing member 25 to the mesh screen sheets 20 such that the reinforcing member 25 penetrates through the mesh screen sheets 20; providing a set of instructions 30 indicating a decoration mode 35 for decorating the wallpapered surface 15; and decorating the wallpapered surface 15 based upon a selected one of the decoration mode 35.

The combination of such claimed elements provides an unpredictable and unexpected result which is not rendered obvious by one skilled in the art. It is envisioned that other styles and configurations of the present invention can be easily incorporated into the teachings of the present invention, and only one particular configuration shall be shown and described for purposes of clarity and disclosure and not by way of limitation of scope.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wall resurfacing kit for allowing users to quickly and easily resurface a damaged wallpapered surface, said kit comprising:

a plurality of mesh screen sheets, said plurality of mesh screen sheets being made of fiberglass and further being directly attachable to said wallpapered surface;

a reinforcing member being applied directly onto said plurality of mesh screen sheets such that said reinforcing member penetrates through said plurality of mesh screen sheets, wherein said reinforcing member directly couples said plurality of mesh screen sheets to said wallpapered surface; and a set of instructions indicating a decoration mode, said decoration mode being used to decorate said wallpapered surface;

wherein said plurality of mesh screen sheets are coextensively shaped and offset from each other when applied to said wallpapered surface;

wherein said mesh screen sheets are arranged in an offset pattern so that a first pair of outer edges of each said mesh screen sheets do not over-lap while a second pair of outer edges of each said mesh screen sheets over-lap when applied to said wallpapered surface.

2. The kit of claim 1, wherein each sheet of said plurality of mesh screen sheets measures approximately eight to twelve feet in length, approximately four feet in width and approximately less than one sixteenths of an inch in thickness.

3. The kit of claim 1, wherein said reinforcing member directly couples said plurality of mesh screen sheets to said wallpapered surface in such a manner that said plurality of mesh screen sheets are intercalated between said reinforcing member and said wallpapered surface.

4. The kit of claim 1, wherein said reinforcing member is a spackling mixture selected from a group of materials comprising: an element a compound, a powder and any combination thereof, said spackling mixture being applied in one form selected from a group comprising a solid, a liquid and a paste.

5. The kit of claim 1, wherein said reinforcing member is configured to be applied over said plurality of mesh screen sheets.

6. The kit of claim 1, wherein said decoration mode of said set of instructions comprises: a wallpaper design, a paint color and a paint applicator.

7. A wall resurfacing kit for allowing users to quickly and easily resurface a damaged wallpapered surface, said kit comprising:

a plurality of rectangular mesh screen sheets, said plurality of mesh screen sheets being made of fiberglass and further being directly attachable to said wallpapered surface;

a reinforcing member being applied directly onto said plurality of mesh screen sheets such that said reinforcing member penetrates through said plurality of mesh screen sheets, wherein said reinforcing member directly couples said plurality of mesh screen sheets to said wallpapered surface; and a set of instructions indicating a decoration mode, said decoration mode being used to decorate said wallpapered surface;

wherein said plurality of mesh screen sheets are coextensively shaped and offset from each other when applied to said wallpapered surface;

wherein said mesh screen sheets are arranged in an offset pattern so that a first pair of outer edges of each said mesh screen sheets do not over-lap while a second pair of outer edges of each said mesh screen sheets over-lap when applied to said wallpapered surface.

8. The kit of claim 7, wherein each sheet of said plurality of mesh screen sheets measures approximately eight to twelve feet in length, approximately four feet in width and approximately less than one sixteenths of an inch in thickness.

9. The kit of claim 7, wherein said reinforcing member directly couples said plurality of mesh screen sheets to said wallpapered surface in such a manner that said plurality of mesh screen sheets are intercalated between said reinforcing member and said wallpapered surface.

10. The kit of claim 7, wherein said reinforcing member is a spackling mixture selected from a group of materials comprising: an element a compound, a powder and any combination thereof, said spackling mixture being applied in one form selected from a group comprising a solid, a liquid and a paste.

11. The kit of claim 7, wherein said reinforcing member is configured to be applied over said plurality of mesh screen sheets.

12. The kit of claim 7, wherein said decoration mode of said set of instructions comprises: a wallpaper design, a paint color and a paint applicator.

13. A method for using a wall resurfacing kit to quickly and easily resurface a damaged wallpapered surface without having to remove damaged wallpaper from said surface, said method comprising:

identifying said damaged wallpapered surface;

providing a plurality of fiberglass and rectangular shaped mesh screen sheets over said damaged wallpapered surface;

providing a reinforcing member;

coupling said plurality of mesh screen sheets directly to said damaged wallpapered surface by directly applying said reinforcing member to said plurality of mesh screen sheets such that said reinforcing member penetrates through said plurality of mesh screen sheets;

providing a set of instructions indicating a decoration mode for decorating said wallpapered surface; and decorating said wallpapered surface based upon a selected one of said decoration mode;

wherein said plurality of mesh screen sheets are coextensively shaped and offset from each other when applied to said wallpapered surface;

wherein said mesh screen sheets are arranged in an offset pattern so that a first pair of outer edges of each said mesh screen sheets do not over-lap while a second pair of outer edges of each said mesh screen sheets over-lap when applied to said wallpapered surface.

14. The method of claim 13, wherein each sheet of said plurality of mesh screen sheets measures approximately eight to twelve feet in length, approximately four feet in width and approximately less than one sixteenths of an inch in thickness.

15. The method of claim 1, wherein said reinforcing member directly couples said plurality of mesh screen sheets to said wallpapered surface in such a manner that said plurality of mesh screen sheets are intercalated between said reinforcing member and said wallpapered surface.

16. The method of claim 13, wherein said reinforcing member is a spackling mixture selected from a group of materials comprising: an element a compound, a powder and any combination thereof, said spackling mixture being applied in one form selected from a group comprising a solid, a liquid and a paste.

17. The method of claim 13, wherein said reinforcing member is configured to be applied over said plurality of mesh screen sheets.

* * * * *